US007572408B2

(12) United States Patent
Wu et al.

(10) Patent No.: US 7,572,408 B2
(45) Date of Patent: Aug. 11, 2009

(54) DUCTILE COBALT-BASED LAVES PHASE ALLOYS

(75) Inventors: James B. C. Wu, St. Louis, MO (US); Matthew X. Yao, Belleville (CA)

(73) Assignee: Deloro Stellite Holdings Corporation, St. Louis, MO (US)

( * ) Notice: Subject to any disclaimer, the term of this patent is extended or adjusted under 35 U.S.C. 154(b) by 0 days.

(21) Appl. No.: 11/015,129

(22) Filed: Dec. 17, 2004

(65) Prior Publication Data

US 2005/0142026 A1 Jun. 30, 2005

Related U.S. Application Data

(60) Provisional application No. 60/533,065, filed on Dec. 29, 2003.

(51) Int. Cl.
*C22C 19/07* (2006.01)

(52) U.S. Cl. ..... 420/436; 420/440

(58) Field of Classification Search ..... 420/435–440
See application file for complete search history.

(56) References Cited

U.S. PATENT DOCUMENTS

| | | | | |
|---|---|---|---|---|
| 2,030,342 | A | 2/1936 | Wissler | |
| 3,180,012 | A | 4/1965 | Smith | |
| 3,244,506 | A * | 4/1966 | Reen | 419/23 |
| 3,257,178 | A | 6/1966 | Severns, Jr. et al. | |
| 3,331,700 | A | 7/1967 | Severns, Jr. et al. | |
| 3,361,560 | A | 1/1968 | Severns, Jr. et al. | |
| 3,410,732 | A * | 11/1968 | Smith | 148/425 |
| 3,795,430 | A | 3/1974 | Farley | |
| 3,839,024 | A * | 10/1974 | Demo et al. | 148/425 |
| RE28,552 | E * | 9/1975 | Smith | 148/425 |
| 4,453,976 | A | 6/1984 | Smythe | |
| 4,465,515 | A | 8/1984 | Mundorff | |
| 4,529,616 | A | 7/1985 | Smythe | |
| 4,618,474 | A * | 10/1986 | Ohe et al. | 420/436 |
| 4,692,305 | A * | 9/1987 | Rangaswamy et al. | 420/436 |
| 5,855,699 | A | 1/1999 | Oyama et al. | |
| 6,066,191 | A | 5/2000 | Tanaka et al. | |
| 6,331,688 | B1 | 12/2001 | Hallen et al. | |
| 6,479,014 | B1 | 11/2002 | Wu et al. | |
| 2002/0168285 | A1 | 11/2002 | Blake et al. | |
| 2004/0219354 | A1 | 11/2004 | Wu et al. | |

FOREIGN PATENT DOCUMENTS

| | | | |
|---|---|---|---|
| EP | 1024209 | A1 | 8/2000 |
| GB | 867455 | * | 5/1961 |

(Continued)

OTHER PUBLICATIONS

ASM International, Materials Park, Ohio, Properties and Selection: Nonferrous Alloys and Special-Purpose Materials: "Rare Earth Metals", pp. 727-728, Oct. 1990.*

(Continued)

*Primary Examiner*—Roy King
*Assistant Examiner*—Jessee R. Roe
(74) *Attorney, Agent, or Firm*—Senniger Powers LLP

(57) ABSTRACT

A Co—Mo—Cr Co-based alloy and overlay for wear and corrosion applications. The Mo:Si ratio is between about 15:1 and about 22:1 for enhanced ductility with a Laves phase.

19 Claims, 9 Drawing Sheets

FOREIGN PATENT DOCUMENTS

| | | | |
|---|---|---|---|
| JP | 06-17177 | * | 7/1992 |
| JP | 04-254542 | | 9/1992 |
| JP | 07-126782 | * | 5/1995 |

OTHER PUBLICATIONS

International Search Report, PCT/US2004/042771; dated Mar. 28, 2007; 4 pages.
Abstract of JP04-254542; Sep. 9, 1992.
ASTM Designation: G133-95, Standard Test Method for Linearly Reciprocating Ball-on-Flat Sliding Wear, 1995.
ASTM Designation: E23-96, Standard Test Methods for Notched Bar Impact Testing of Metallic Materials, 1996.
Standard Practice for Laboratory Immersion Corrsion Testing of Metals, The American Society for Testing and Materials, Designation: G 31-72, pp. 95-102, (Reapproved 1995).
Abstract of JP04254541; Sep. 9, 1992.
Abstract of JP05084592; Apr. 6, 1993.
Abstract of JP02236239; Sep. 19, 1990.
Abstract of JP06017176; Jan. 25, 1994.
Abstract of JP01272738; Oct. 31, 1989.
Abstract of JP07018350; Jan. 20, 1995.
Abstract of JP07300642; Nov. 14, 1995.
European Search Report, EP04814903; Apr. 27, 2009, 4 pages.

* cited by examiner

DUCTILE COBALT-BASED LAVES PHASE ALLOYS

REFERENCE TO RELATED APPLICATION

This application claims priority from U.S. provisional application Ser. No. 60/533,065, filed on Dec. 29, 2003.

FIELD OF THE INVENTION

This invention is directed to alloys for use in industrial applications where resistance to wear and corrosion are required. Examples of such applications include weld overlaying rolls or plates used in hot-dip galvanizing, and overlaying steel mill rolls which contact hot steel slabs.

BACKGROUND OF THE INVENTION

Certain alloys in commercial use for wear and corrosion applications are distributed by Deloro Stellite Company, Inc. under the trade designation Tribaloy. Alloys within the Tribaloy alloy family are disclosed in U.S. Pat. Nos. 3,410,732, 3,795,430, 3,839,024, and in pending U.S. application Ser. No. 10/250,205. Three specific alloys in the Tribaloy family are distributed under the trade designations T-400, T-800, and T-400C. The nominal composition of T-400 is Cr-8.5%, Mo-28%, Si-2.6%, and balance Co. The nominal composition of T-800 is Cr-17%, Mo-28%, Si-3.25%, and balance Co. The nominal composition of T-400C is Cr-14%, Mo-26%, Si-2.6%, and balance Co.

The foregoing alloys as well as other alloys utilize a so-called "Laves" phase (named after its discoverer Fritz Laves) to increase the hardness of the alloy. In general, Laves phases are intermetallics, i.e. metal-metal phases, having an $AB_2$ composition where the A atoms are ordered as in a diamond, hexagonal diamond, or related structure, and the B atoms form a tetrahedron around the A atoms. Laves phases are strong and brittle, due in part to the complexity of their dislocation glide processes. A Laves phase alloy of further enhanced ductility over current commercial Laves phase alloys is therefore desirable for certain applications.

SUMMARY OF THE INVENTION

Among the objects of this invention are to provide a Co-based alloy with a microstructure comprising a hard Laves phase that displays greater ductility than known Co-based Laves phase alloys.

Briefly, therefore, the invention is directed to a Co—Mo—Cr Co-based metallic composition for forming a wear- and corrosion-resistant overlay on a metallic substrate, the metallic composition comprising Si between about 0.5 wt % and about 1.5 wt %, and having a Mo:Si ratio of between about 15:1 and about 22:1.

The invention is also directed to a wear- and corrosion-resistant overlay on a metallic substrate, the overlay comprising a Co—Mo—Cr Co-based alloy comprising Si between about 0.5 wt % and about 1.5 wt %, and having a Mo:Si ratio of between about 15:1 and about 22:1.

And in another aspect the invention is a method for imparting wear resistance and corrosion resistance to a surface of a metallic substrate, the method comprising melting a Co—Mo—Cr Co-based alloy that solidifies as an overlay on the substrate surface, wherein the Co-based alloy comprises Si between about 0.5 wt % and about 1.5 wt %, and has a Mo:Si ratio of between about 15:1 and about 22:1.

Other objects and features of the invention will be in part apparent and in part pointed out hereinafter.

DETAILED DESCRIPTION OF THE INVENTION

Figure 1:
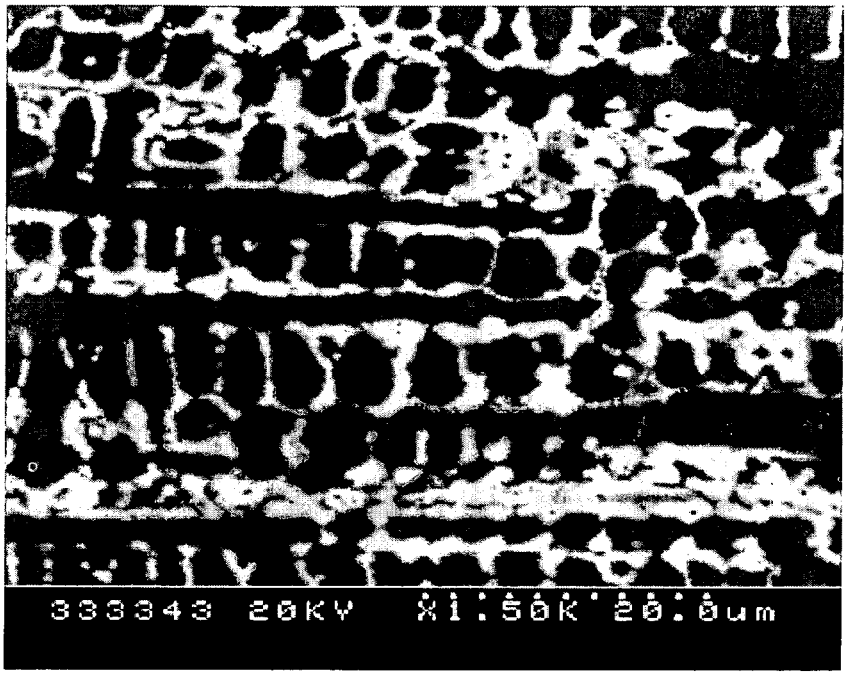
FIG. 1 is a photomicrograph illustrating the microstructure of the invention.

Chromium is provided in the alloys of the invention to enhance corrosion resistance. The Cr content is preferably in the range of about 12% to 18%. All percentages herein are by weight unless specified otherwise. A minimum of about 12% Cr is required to provide adequate corrosion resistance. The Cr content is maintained below about 18% because it has been discovered that other brittle intermetallics may tend to form at Cr contents above about 18%. In one embodiment, the concentration of Cr is between about 14 wt % and about 17 wt %. In one preferred embodiment, the concentration of Cr is about 16.2 wt %.

Silicon is provided in the alloys of the invention to impart wear resistance in combination with Mo. This Si content is appreciably lower - on the order of more than 40% lower, relatively - than the Si content of analogous prior Laves phase alloys. The Si content is preferably in the range of about 0.5% to 1.5%. The Si content is at least about 0.5% to provide enough Si for the formation of Laves phase. The Si content is maintained below about 1.5% in order to avoid or at least minimize the manifestation of Laves phase as blocky particles. In one embodiment, the concentration of Si is between about 0.75 wt % and about 1.35 wt %. In one preferred embodiment, the concentration of Si is about 1.27 wt %.

Molybdenum is provided in the alloys of the invention in an amount up to about 28% to impart wear resistance. It has been discovered that if the Mo content is greater than about 28%, other brittle intermetallics may form. A further requirement on the Mo content is that it be at least about 12% to provide sufficient wear resistance. Therefore, the concentration of Mo in the alloy is between about 12 wt % and about 28 wt %. For example, the concentration of Mo is between about 18 wt % and about 24 wt %. In one preferred embodiment, the concentration of Mo is about 22.3 wt %. Within these guidelines, the Mo content is selected as a function of the Si content. In particular, Mo is selected to provide a Mo:Si weight percent ratio of between about 15:1 and about 22:1.

These two requirements on the Mo content must be independently satisfied in that, e.g., when the Si content is 0.5%, the Mo content must still be at least about 12%, even though an amount as low as 7.5% would satisfy the Mo:Si range of 15:1-22:1. Similarly, when the Si content is about 1.5%, the Mo content cannot be higher than about 28%, even though an amount as high as 33% would satisfy the Mo:Si range. And when the Si content is 1%, the Mo content must be between about 15 and 22%, and cannot be as high as 28%; though 28% is acceptable when the Si content is, e.g., 1.27%. In one embodiment, the Mo:Si ratio is between about 16:1 to about 19:1. In one preferred embodiment, the Mo:Si ratio is about 17.6:1.

Cobalt is provided in the alloys as the alloy matrix. Cobalt is selected because it can be alloyed with the elements Cr, Mo, and Si and tends to form a tough matrix. Cobalt is selected over Ni, Fe, combinations thereof, and combinations thereof with Co because it has been discovered that a matrix which consists essentially of Co is tougher and less brittle than a matrix which contains some Ni and/or Fe. The Co content is preferably in the range of 51 to 75%. One preferred embodiment employs about 59% Co.

Carbon is employed in the alloys to balance the Mo partition in the Laves phase by tying up a portion of the Mo as carbides. It has been found that carbon plays a role in resulting in a desirable microstructure. Carbon is believed to also function to form nucleation sites for the Laves phase. Carbon is therefore employed in an amount of at least about 0.1%. Carbon is maintained below about 1%, because it is thought that above about 1% excessive carbide formation would retard the formation of Laves phase. Therefore, the C has a concentration between about 0.1% and about 1%. In one such embodiment, the C has a concentration between about 0.1 wt % and about 0.5 wt %. In one preferred embodiment, the C concentration is about 0.21 wt %.

Certain trace elements are present in the alloys of the invention due to the presence of such elements in scrap and otherwise due to the manufacturing process. These elements are not intentionally added, but are tolerable. Nickel may be present up to about 3%. Iron may be present up to about 3%. Boron may be intentionally present up to about 1% to enhance the alloy's molten state fluidity, fusing characteristics, or sintering properties. While the combination of these element tolerances is up to 8%, in a preferred embodiment the total trace element content is no more than 2%.

Grain refiners V, Zr, Hf, Nb, Ta, and/or rare earth elements are optionally included in amounts up to about 2% cumulatively for microstructure refinement.

A further aspect of the invention in certain embodiments is that the alloy is Mn-free, Cu-free, and free of all alloying elements having a material effect on metallurgical properties other than Cr, Mo, Si, and C in the Co matrix. As a further variation the alloy is free of all alloying elements having a material effect on metallurgical properties other than Cr, Mo, Si, C, and the aforementioned grain refiners in the Co matrix.

The hardness of the alloy is between about 40 and about 52 HRC (Rockwell C scale).

In one aspect the microstructure of the invention typically consists of 8-30% by volume Laves phase, depending on the chemical composition and cooling rate.

The alloys of the invention are provided in the form of powder for deposition by plasma transfer arc welding deposition, laser cladding, plasma spraying, and high velocity oxyfuel spraying. The alloys can also be provided in the form of welding rods, wires, and electrodes for deposition by gas tungsten arc welding, shielded metal arc welding, or gas metal arc welding. The alloys are also provided in the form of castings and powder metallurgical components. Accordingly, the term alloy as used herein encompasses the metallic composition as an alloy in the classic metallurgical sense in that its elemental metal constituents have been melted together and coalesced, and also encompasses the metallic composition as a powder blend, a tubular wire containing powder, and the like which has not yet been melted together and coalesced.

Regardless of the alloy's form or application technique to a substrate, the alloy exhibits lower crack sensitivity than comparable Laves phase alloys. If an alloy has high crack sensitivity, the substrate must be preheated before applying the alloy as a coating to prevent fractures resulting from a significant temperature difference between the substrate and the molten alloy. Applications of the alloy of the invention do not necessarily require this preheating step.

Certain aspects of the invention are further illustrated in the following examples.

EXAMPLE 1

Five alloy powders were prepared with the following respective compositions:

| | Cr | Mo | Si | C | Co | Mo:Si |
|---|---|---|---|---|---|---|
| Alloy 1 | 14.1 | 27 | 1.03 | 0.004 | 53.9 | 26.2 |
| Alloy 2 | 15.2 | 25.4 | 1.01 | 0.10 | 57.7 | 25.1 |
| Alloy 3 | 16.2 | 22.3 | 1.27 | 0.21 | 59.6 | 17.6 |
| T-400 | 8.5 | 28 | 2.6 | 0.04 | 59.9 | 10.8 |
| T-800 | 17 | 28 | 3.3 | 0.04 | 50.7 | 8.5 |

The powders were screened to a size of 45 to 150 microns and applied to a substrate by plasma transferred arc welding.

EXAMPLE 2

The alloys of Example 1 were tested for hardness by conventional Rockwell testing (HRC), and were tested for cracking sensitivity by plasma transferred arc welding using 170-200 amps at 22 volts with a powder feed rate of 25-32 grams per minute and a travel speed of 100-135 mm/minute. The following results were obtained:

| | HRC | Cracking Sensitivity | Mo:Si |
|---|---|---|---|
| Alloy 1 | 55 | High | 26.2 |
| Alloy 2 | 49 | Medium | 25.1 |
| Alloy 3 | 48 | Low | 17.6 |
| T-400 | 52 | Medium | 10.8 |
| T-800 | 58 | High | 8.5 |

These results demonstrate that the ratio of Mo:Si has a profound effect on alloy ductility, with substantially enhanced crack sensitivity performance achieved by Alloy 3 having a Mo:Si ratio in the 15:1 to 22:1 range of a preferred aspect of the invention.

EXAMPLE 3

Figure 2:
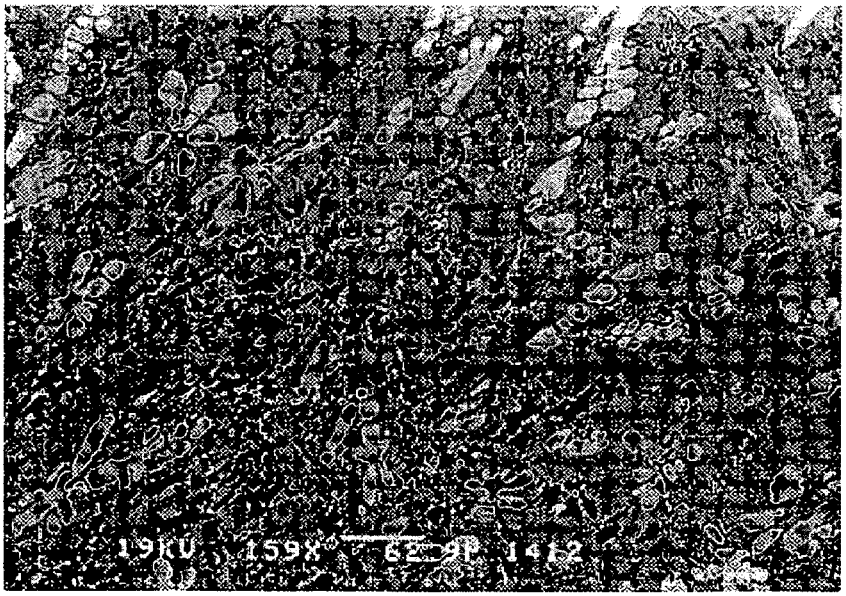
FIG. 2 is a photomicrograph illustrating the microstructure of a prior art alloy.

A cross section of the weld deposit of Alloy 3 was prepared, and a scanning electron microscope (SEM) photomicrograph at 1500× magnification is presented in FIG. 1. FIG. 1 is a back-scattered image which illustrates the dendrites as dark areas and the interdendritic regions as light areas. This illustrates that the microstructure is hypoeutectic. A hypoeutectic microstructure is generally more ductile than a hypereutectic one. This microstructure is in contrast to conventional Laves phase microstructure such as FIG. 2 in U.S. Pat. No. 6,066, 191, reproduced here as FIG. 2, which includes a number of blocky, flower-like Laves phase particles.

EXAMPLE 4

Figure 3:
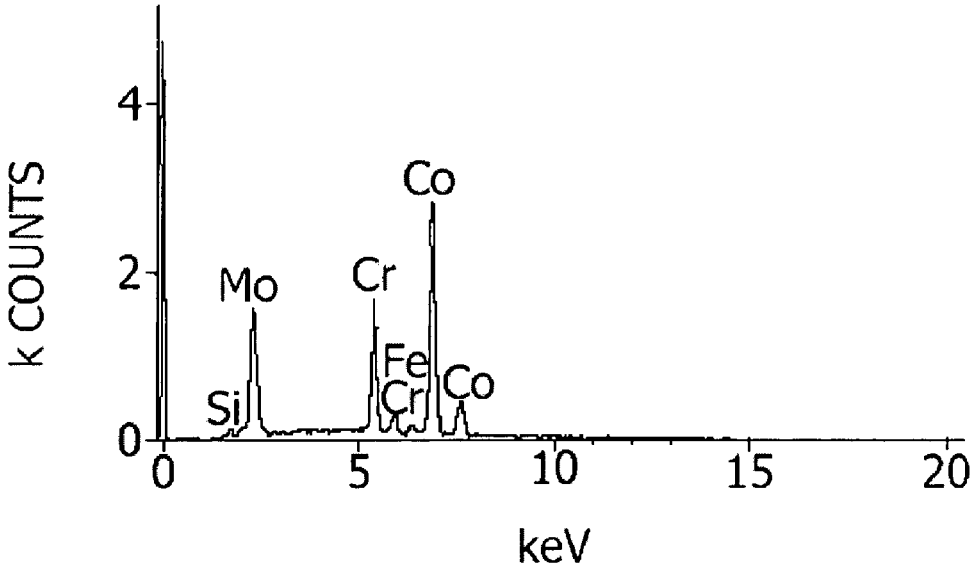
FIGS. 3-5 are energy dispersive spectra for illustrating certain aspects of the invention, as described below.
Figure 4:
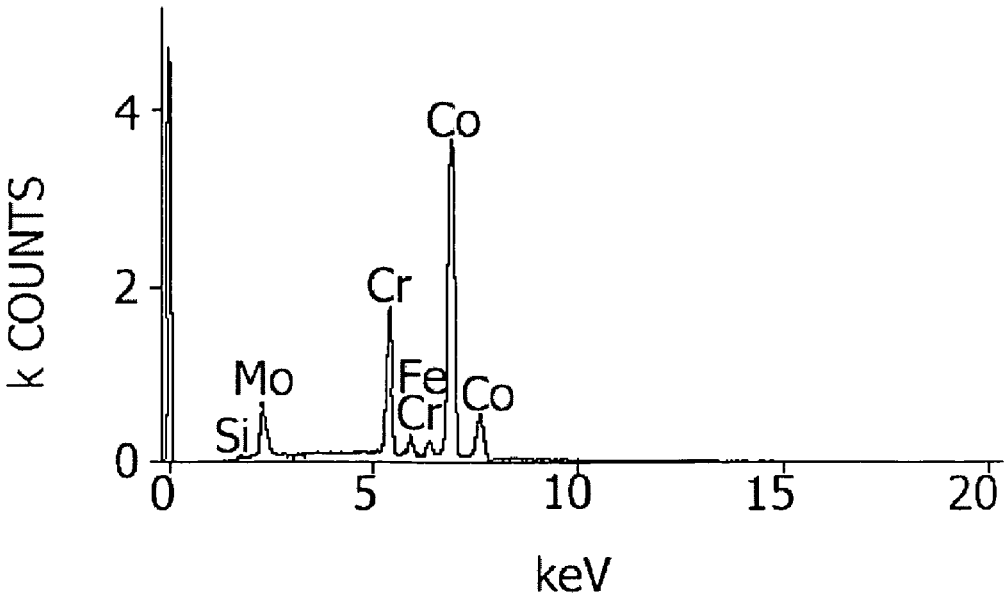

An energy dispersive spectrum presented in FIG. 3 was generated of the interdendritic (light) region of Alloy 3, and one presented in FIG. 4 was generated for the dendritic (dark) region of the alloy. These reveal a greater concentration of Mo and Si in the interdendritic (light) region. Since the greater Mo and Si content is known to correspond to hard Laves particles, the greater concentration of Mo and Si in the interdendritic (light) regions indicates the presence of Laves phase in those interdendritic (light) regions.

EXAMPLE 5

Figure 5:
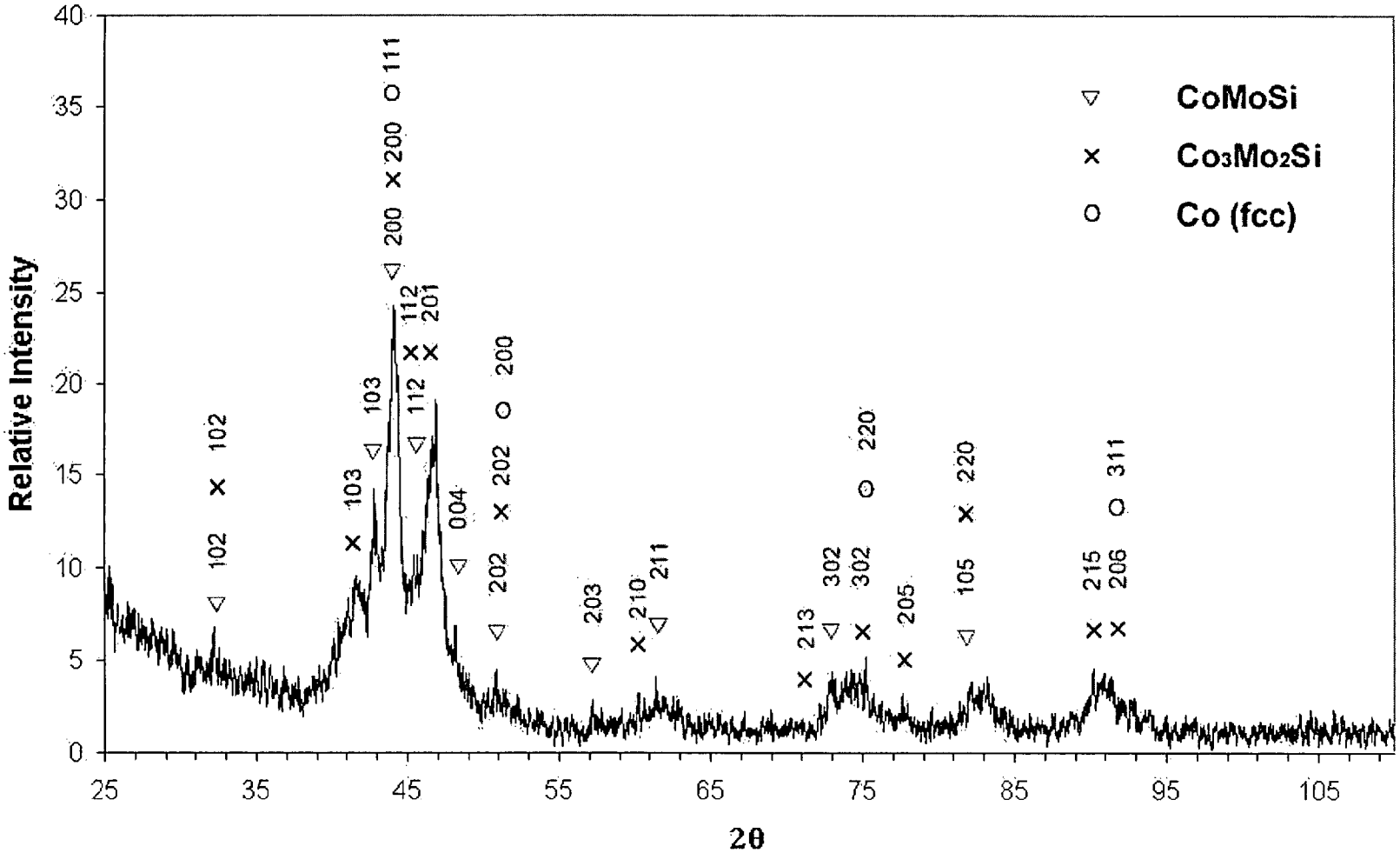

The Alloy 3 weld deposit was then examined by X-Ray diffraction, and the results presented in FIG. 5. The location of the peaks in FIG. 5 demonstrate Laves phase forms CoMoSi and $Co_3Mo_2Si$. This corresponds to an $AB_2$ composition of Laves phase, with Mo as the A atoms and Co and Si as the B atoms.

EXAMPLE 6

Ten alloys were prepared with the following compositions of selected alloying elements:

| | Cr | Mo | Si | C | Ni | Fe | Co | Mo:Si |
|---|---|---|---|---|---|---|---|---|
| A286 | 14.8 | 1.3 | 1.0 | 0.8 | 25.5 | Bal | 0 | 1.3 |
| 310SS | 25 | 0 | 1.5 | 0.08 | 20.5 | Bal | 0 | 0 |
| XEV-F | 22.2 | 0.35 | 0.3 | 0.5 | 3.5 | Bal | 0 | 1.2 |
| 440C | 18 | 0.75 | 1.0 | 1.2 | 0 | Bal | 0 | 0.75 |
| X-5000 | 22.5 | 7.0 | 0.3 | 0.75 | 4.0 | Bal | 10 | 23.3 |
| T-506 | 35 | 0 | 1 | 1.6 | 0 | 0 | Bal | 0 |
| T-400 | 8.5 | 28 | 2.6 | 0.04 | 0 | 0 | Bal | 10.8 |
| T-401 | 16.2 | 22.3 | 1.27 | 0.21 | 0 | 0 | Bal | 17.6 |
| T-400C | 14 | 26 | 2.6 | 0.08 | 0 | 0 | Bal | 10.0 |

The alloy designated as T-401 in this Example, as well as those that follow, is the same as Alloy 3 from Example 1.

Figure 6:
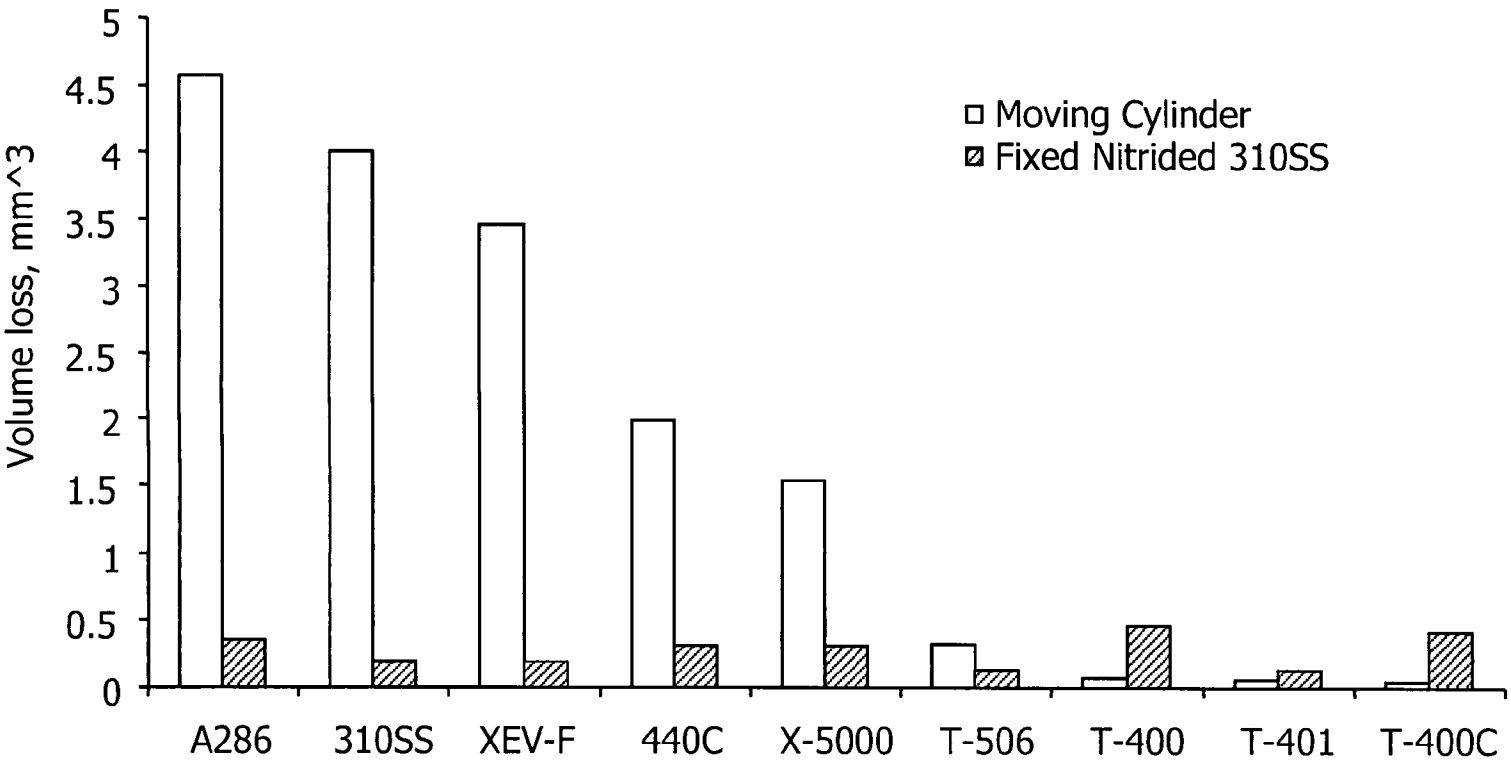
FIG. 6 is a graph comparing the high temperature wear resistance data from the Plint test.
Figure 7:
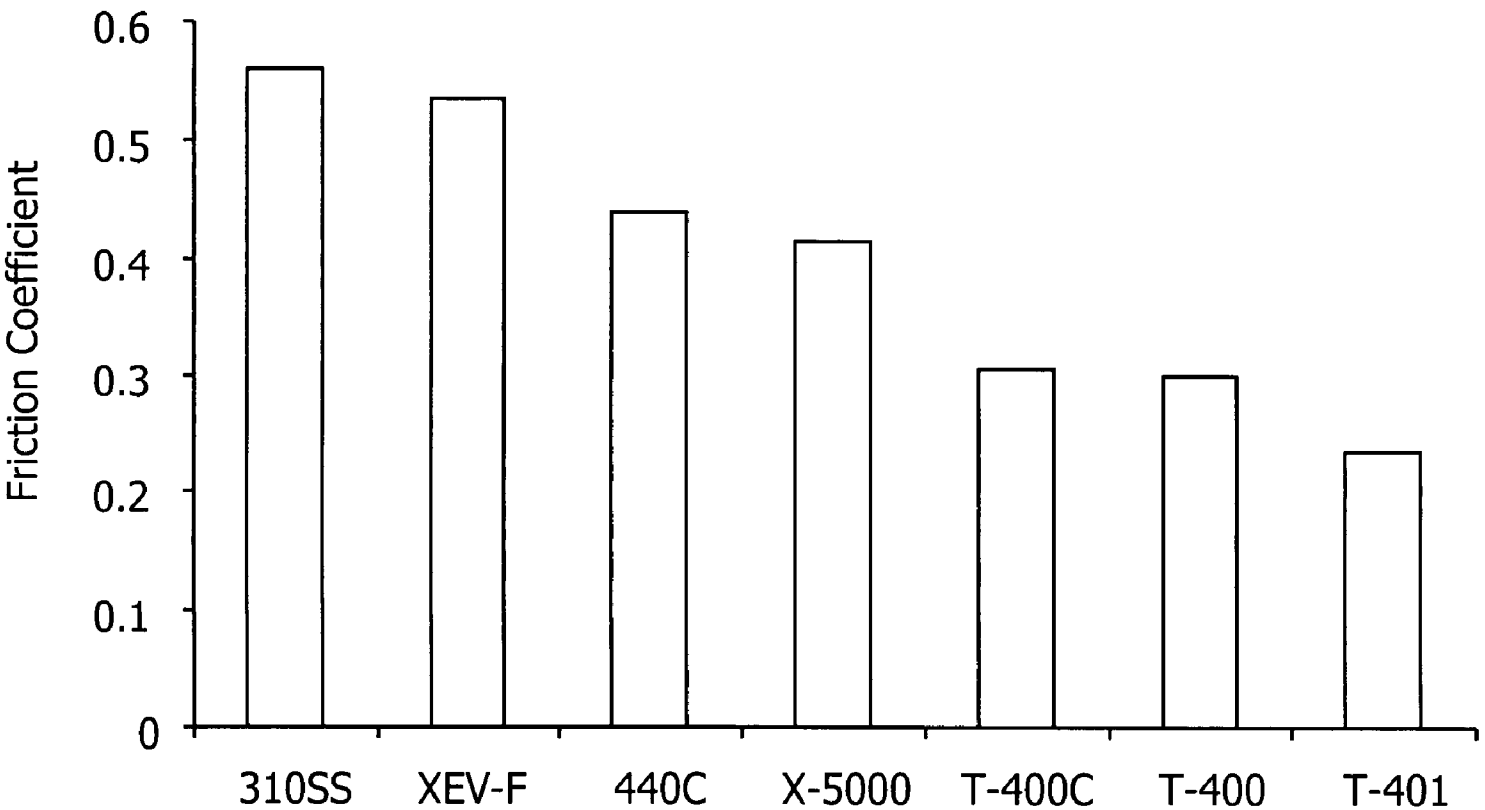
FIG. 7 is a graph comparing the coefficient of friction of the alloys tested in Example 6.

These alloys were tested for high temperature wear resistance with a Plint test (ASTM G133-95). The Plint test was conducted with an investment cast specimen of each alloy in cylinder form. The cylinders were moved against a flat specimen of nitrided 310 stainless steel without lubrication, at 482° C., with a 13.3 mm stroke, 222.3 N of force, 30 Hz frequency, and a sliding distance of 400 m. The results of the testing can be seen in FIG. 6. The corresponding coefficient of friction for selected samples is shown in FIG. 7. This data shows that Alloy 3 exhibits superior high temperature wear resistance.

EXAMPLE 7

Figure 8:
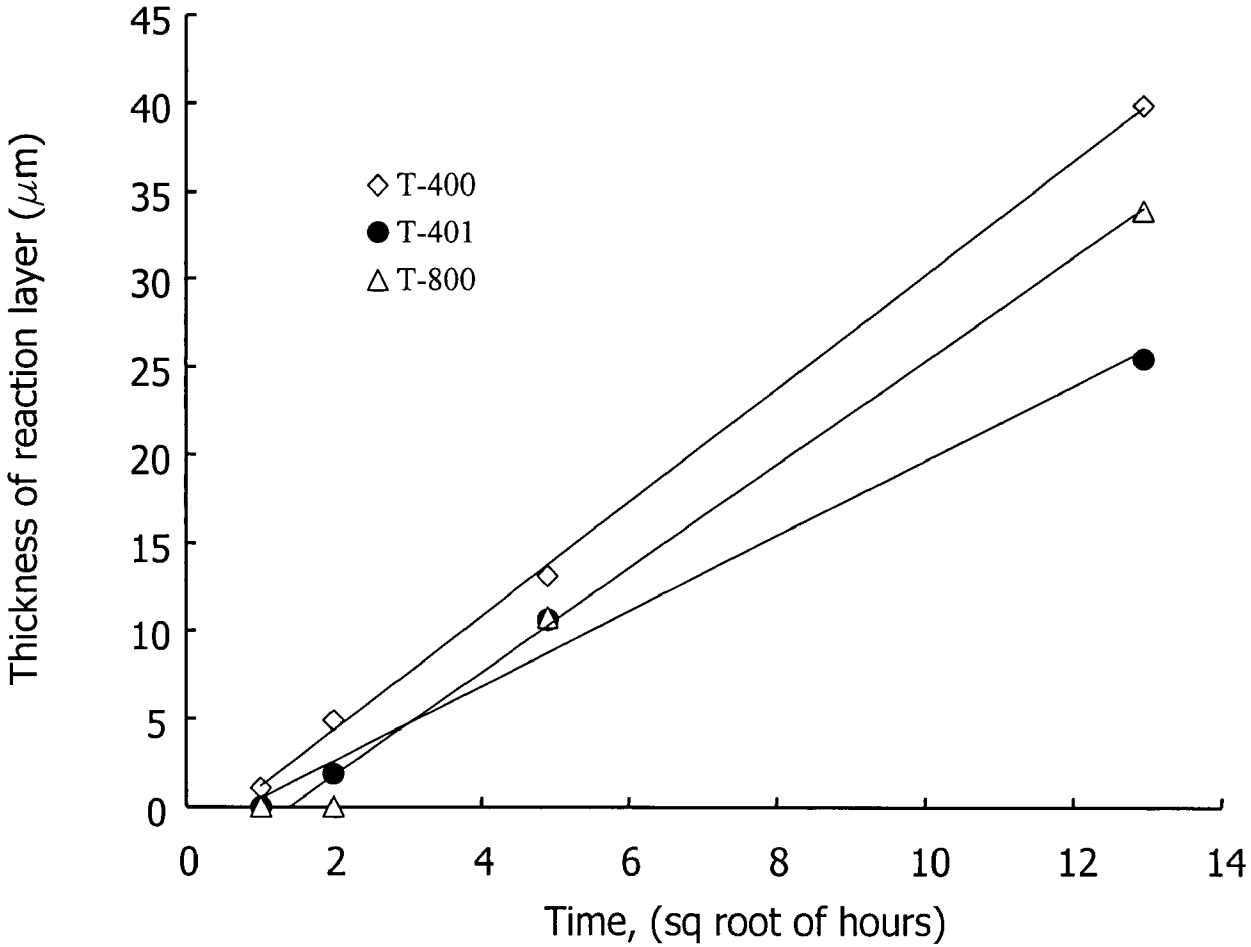
FIG. 8 is a graph showing the thickness of the reaction layer from Example 7's corrosion resistance test.

Alloy 3, T-400, and T-800 of Example 1 were tested for corrosion resistance by immersing a sample of each in a 0.22%-Al Zn bath saturated with Fe at 470° C. for 168 hours. The results of this test are shown in FIG. 8. The data shows that Alloy 3 exhibits superior corrosion resistance. As such, the alloy of this invention is well suited for use on Zn galvanizing rolls and on stabilizing rolls for Zn galvanizing.

EXAMPLE 8

Figure 9:
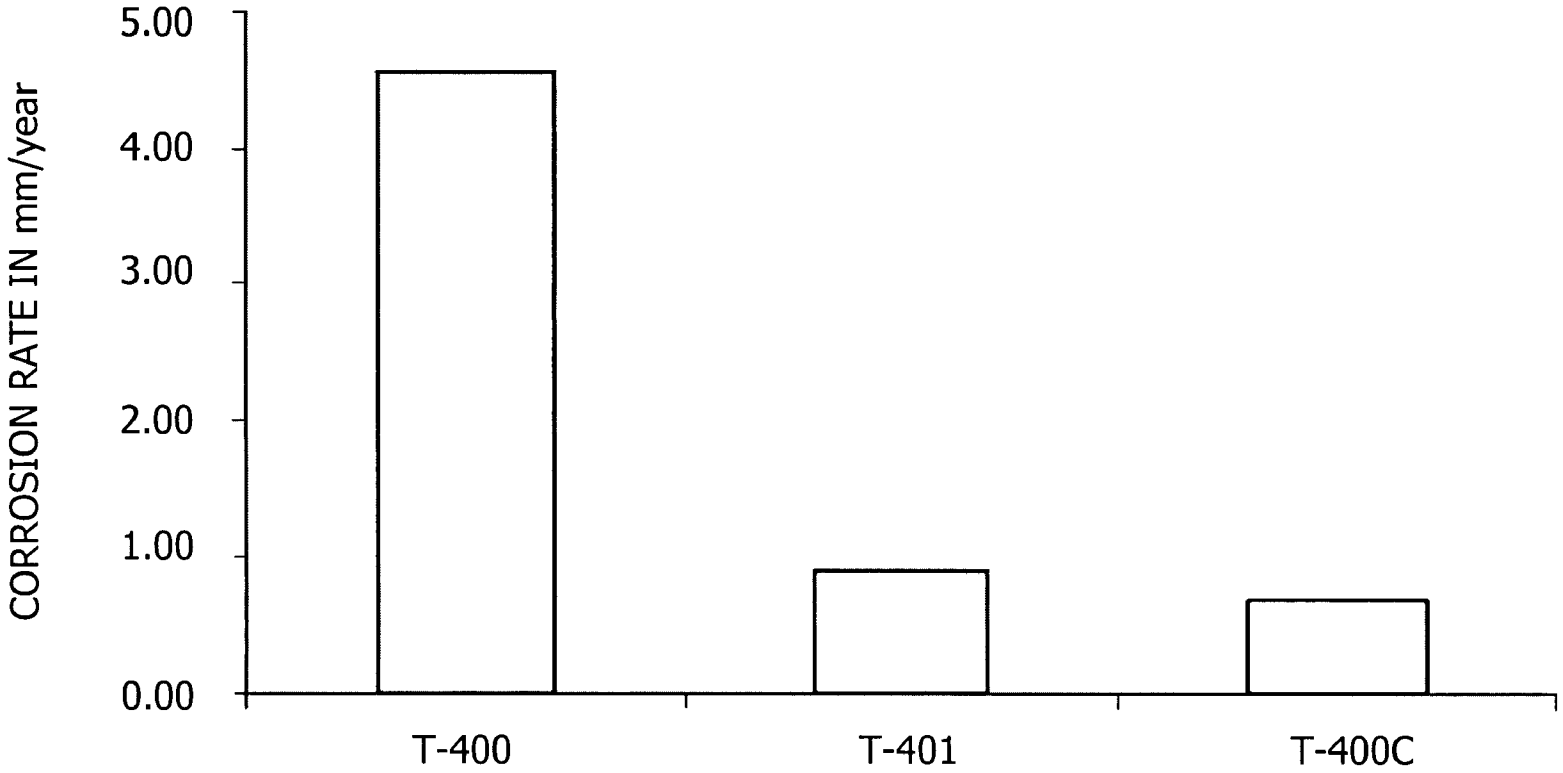
FIG. 9 is a graph showing the corrosion rate, in mm/year, from Example 8's $H_2SO_4$ corrosion resistance test.
Figure 10:
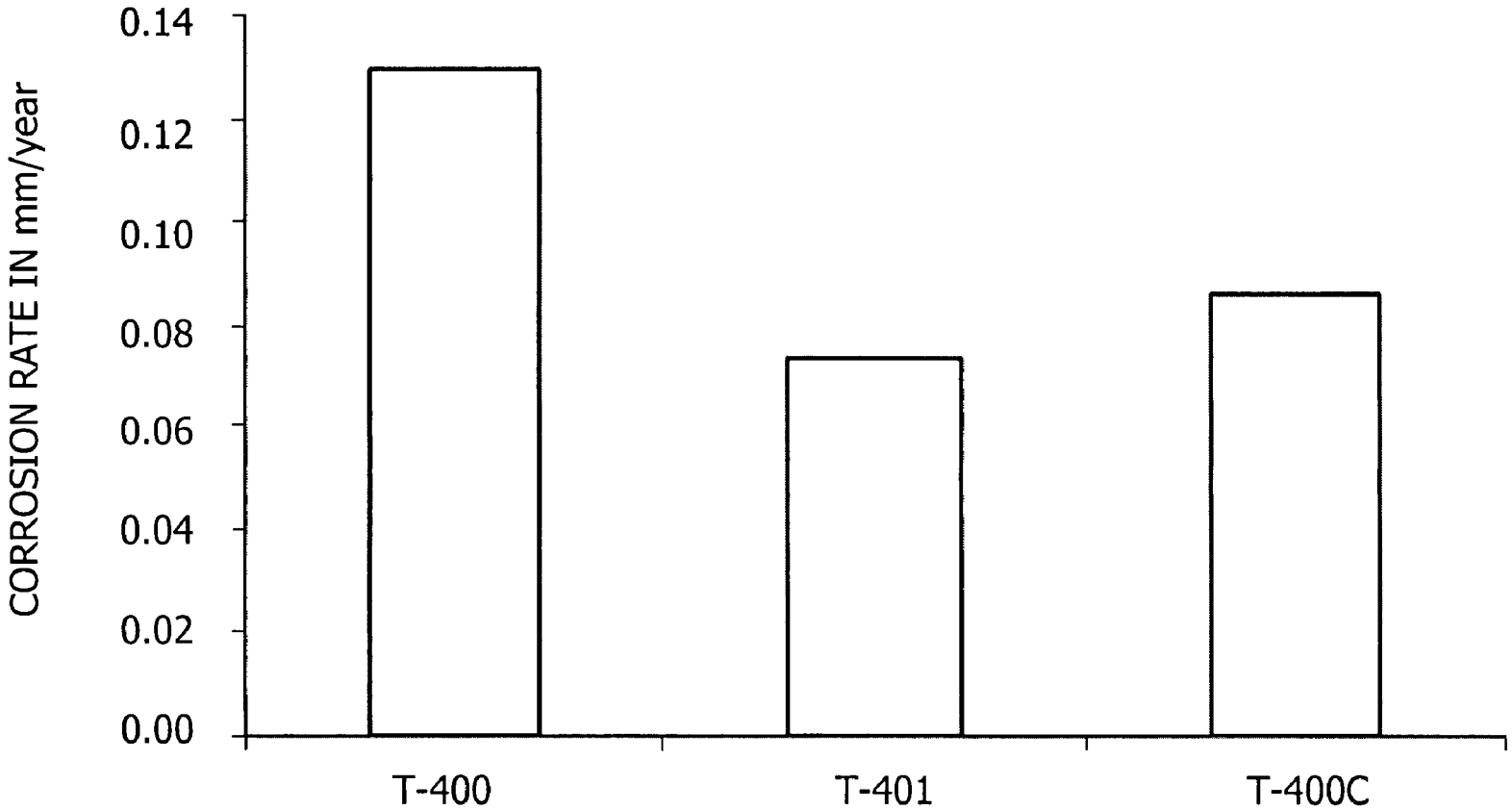
FIG. 10 is a graph showing the corrosion rate, in mm/year, from Example 8's HCl corrosion resistance test.

Alloy 3 and T-400 of Example 1, as well as T-400C, were tested for further corrosion resistance to $H_2SO_4$ and HCl. The nominal composition of T-400C is shown above in Example 6. The results of corrosion tests conducted according to test procedure ASTM G31-72 are illustrated in FIGS. 9 and 10. Specifically, FIG. 9 shows the results of the test where a sample of each alloy was immersed in a 10% $H_2SO_4$ solution at boiling (about 102° C.) according to ASTM G31-72. FIG. 10 shows the results of the test where a sample of each alloy was immersed in a 5% HCl solution at 66° C. The data show that Alloy 3 exhibits desirable corrosion resistance in each environment. In particular, Alloy 3 demonstrates corrosion resistance in $H_2SO_4$ characterized by less than about 1.0 mm/year thickness loss. In another aspect, Alloy 3 demonstrates corrosion resistance in HCl characterized by less than about 0.08 mm/year thickness loss.

EXAMPLE 9

Figure 11:
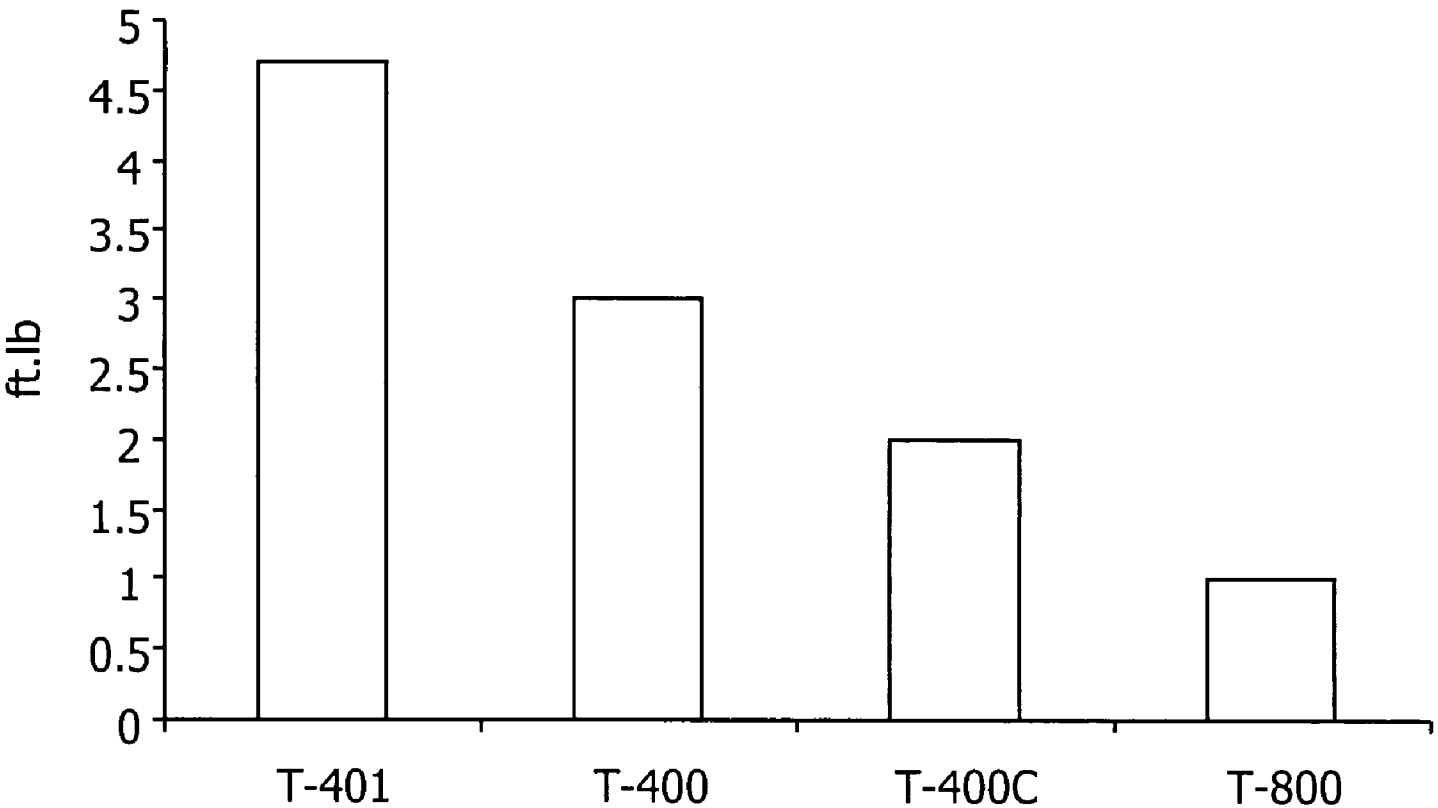
FIG. 11 is a graph showing the impact toughness results from Example 9.

Alloy 3, T-400, and T-800 of Example 1, as well as T-400C from Example 6, were tested for impact resistance with a Charpy impact test according to ASTM specification E23-96. The data from this test is shown in FIG. 11. The data shows that Alloy 3 exhibits superior impact resistance, and therefore superior toughness, than comparable Laves phase alloys. Specifically, the Alloy 3 sample shows an impact resistance of at least about 4.5 ft-lb under the ASTM E23-96 test.

EXAMPLE 10

Alloy 3 from Example 1 was applied to a substrate to form an overlay, whereby the final component's wear and corrosion resistance were improved relative to the untreated substrate. In one embodiment, Alloy 3 was used in the preparation of a roller for a Zn galvanizing operation. In one preferred embodiment, the preparation included forming a new overlay on the roller, while in another preferred embodiment, the preparation included rework or repair of an existing overlay. In these embodiments, the roller was approximately 8 inches in diameter and 72 inches long. Plasma transferred arc welding was used to apply Alloy 3 in powder form to the roller's surface. Heat sufficient to melt Alloy 3 was generated to form a weld pool on the roller. The weld pool comprised molten Alloy 3 as well as some molten substrate material. In this application, the roller was 316 stainless steel. The arc and source of Alloy 3 powder were maneuvered over the roller's surface such that the weld pool solidified in a substantially continuous and uniform overlay. The overlay surface was then finished to provide a smooth surfaced roller.

As various changes could be made in the above embodiments without departing from the scope of the invention, it is intended that all matter contained in the above description shall be interpreted as illustrative and not in a limiting sense.

What is claimed is:

1. A Co—Mo—Cr Co-based metallic composition for forming a wear- and corrosion-resistant overlay on a metallic substrate, the metallic composition comprising, by weight percent:

14-17 Cr, 18-24 Mo, 0.75-1.35 Si, 0.1-0.5 C, and balance Co, wherein the metallic composition has a Mo:Si ratio of between 15:1 and 22:1, and wherein the wear- and corrosion-resistant overlay formed by the metallic composition has a hypoeutectic microstructure that comprises between about 8 vol % and about 30 vol % Laves phase.

2. The Co-based metallic composition of claim 1 wherein the metallic composition has a hardness between about 40 and about 52 HRC (Rockwell C scale).

3. The Co-based metallic composition of claim 1 consisting of, by weight percent:

14-17 Cr,
18-24 Mo,
0.75-1.35 Si,
0.1-0.5 C,
up to about 1% B,
up to about 3% Ni,
up to about 3% Fe,
wherein the total concentration of B, Ni, Fe is less than about 8 wt %, and
balance Co.

4. The Co-based metallic composition of claim 3 wherein the Mo:Si ratio is between 16:1 and 19:1.

5. The Co-based metallic composition of claim 3 wherein the metallic composition has a hardness between about 40 and about 52 HRC (Rockwell C scale).

6. The Co-based metallic composition of claim 1 wherein the Mo:Si ratio is between 16:1 and 19:1.

7. The Co-based metallic composition of claim 1 further comprising, by weight percent:

up to about 1% B
up to about 3% Ni
up to about 3% Fe;
and additional trace elements wherein the total concentration of B, Ni, Fe, and additional trace elements is less than about 8 wt %.

8. The Co-based metallic composition of claim 1 further comprising a grain refiner selected from the group of grain refiners consisting of V, Zr, Hf, Ta, and rare earth elements, and any combination thereof.

9. The Co-based metallic composition of claim 1 consisting of, by weight percent:

14-17% Cr,
18-24% Mo,
0.75-1.35% Si,
0.1-0.5% C,
up to 2% of a grain refiner selected from the group of grain refiners consisting of V, Zr, Hf, Ta, and rare earth elements, and any combination thereof, and
balance Co.

10. The Co-based metallic composition of claim 9 wherein the Mo:Si ratio is between 16:1 and 19:1.

11. The Co-based metallic composition of claim 9 wherein the metallic composition has a hardness between about 40 and about 52 HRC (Rockwell C scale).

12. The Co-based metallic composition of claim 1 consisting of, by weight percent:

16.2% Cr,
22.3% Mo,
1.27% Si,
0.21% C,
up to about 1% B,
up to about 3% Ni,
up to about 3% Fe,
wherein the total concentration of B, Ni, Fe is less than about 8 wt %, and
balance Co.

13. The Co-based metallic composition of claim 12 wherein the Mo:Si ratio is between 16:1 and 19:1.

14. The Co-based metallic composition of claim 12 wherein the metallic composition has a hardness between about 40 and about 52 HRC (Rockwell C scale).

15. The Co-based metallic composition of claim 1 wherein the composition is Mn-free.

16. The Co-based metallic composition of claim 15 wherein the composition is further Cu-free and free of all alloying elements having a material effect on metallurgical properties other than Cr, Mo, Si, and C in the Co matrix.

17. The Co-based metallic composition of claim 1 consisting of, by weight percent:

14-17 Cr,
18-24 Mo,
0.75-1.35 Si,
0.1-0.5 C,
up to about 1% B,
up to about 3% Ni,
up to about 3% Fe,
wherein the total concentration of B, Ni, Fe is less than about 8 wt %,
up to 2% of a grain refiner selected from the group of grain refiners consisting of V, Zr, Hf, Ta, and rare earth elements, and any combination thereof, and
balance Co.

18. The Co-based metallic composition of claim 17 wherein the Mo:Si ratio is between 16:1 and 19:1.

19. The Co-based metallic composition of claim 17 wherein the metallic composition has a hardness between about 40 and about 52 HRC (Rockwell C scale).

* * * * *